US007437803B2

(12) United States Patent
Watanabe et al.

(10) Patent No.: US 7,437,803 B2
(45) Date of Patent: Oct. 21, 2008

(54) GRIP HANDLE TYPE DOOR HANDLE APPARATUS

(75) Inventors: Naoki Watanabe, Kanagawa (JP); Satoshi Kubota, Kanagawa (JP)

(73) Assignee: Alpha Corporation, Yokohama-shi (JP)

( * ) Notice: Subject to any disclaimer, the term of this patent is extended or adjusted under 35 U.S.C. 154(b) by 88 days.

(21) Appl. No.: 11/138,387

(22) Filed: May 27, 2005

(65) Prior Publication Data

US 2005/0275226 A1 Dec. 15, 2005

(30) Foreign Application Priority Data

May 31, 2004 (JP) ..... P2004-162280

(51) Int. Cl.
*E05B 3/00* (2006.01)

(52) U.S. Cl. ..... 16/412; 292/336.3

(58) Field of Classification Search ..... 16/110.1, 16/408, 412, 413, 422, 431, 436, 438, 110 R, 16/112, DIG. 41; 296/146.6; 277/904, 921, 277/644; 292/336.3, 307 R, 354
See application file for complete search history.

(56) References Cited

U.S. PATENT DOCUMENTS 3,789,550 A * 2/1974 Seiwert ..... 49/503
4,511,172 A * 4/1985 Tabata et al. ..... 49/460
5,352,004 A * 10/1994 Nedbal ..... 292/347
5,943,737 A * 8/1999 Tomimitsu et al. ..... 16/412
6,042,159 A * 3/2000 Spitzley et al. ..... 292/216
6,167,592 B1 * 1/2001 Tsai ..... 16/411
6,234,041 B1 * 5/2001 Larabet et al. ..... 74/523
6,447,030 B1 * 9/2002 Meinke ..... 292/347
6,527,316 B1 * 3/2003 Agostini et al. ..... 292/347
6,588,813 B1 * 7/2003 Marcarini et al. ..... 292/347
6,769,154 B1 * 8/2004 Klein et al. ..... 16/412
6,871,887 B2 * 3/2005 Jooss et al. ..... 292/336.3
6,954,967 B2 * 10/2005 Park et al. ..... 16/412
2003/0001396 A1 * 1/2003 Jooss et al. ..... 292/201

FOREIGN PATENT DOCUMENTS

JP 2002-295059 10/2002
JP 2003247357 * 9/2003
JP 2005344303 * 12/2005
JP 2006002447 * 1/2006

* cited by examiner

*Primary Examiner*—Robert J Sandy
(74) *Attorney, Agent, or Firm*—Nath Law Group; Jerald L. Meyer; Stan N. Protigal

(57) ABSTRACT

A door handle apparatus comprising a grip member whose one end is rotatably supported by a door panel, and an escutcheon which is disposed closer to the other end surface of the grip member and which is fixed to the door panel, wherein the door handle apparatus further comprises a water force reducing structure which reduces force of water which enters from a gap between the grip member and the escutcheon.

13 Claims, 5 Drawing Sheets

GRIP HANDLE TYPE DOOR HANDLE APPARATUS

CROSS REFERENCE TO RELATED APPLICATIONS

This application is based upon and claims the benefit of priority from the prior Japanese Patent Application No. P2004-162280, filed on May 31, 2004: the entire contents of which are Incorporated herein by reference.

BACKGROUND OF THE INVENTION

1. Field of the Invention

The present invention relates to a grip handle type door handle apparatus used for opening and closing a door.

2. Description of the Related Art

A grip handle type door handle apparatus is conventionally widely used for opening and closing a door of a vehicle from outside. A conventional door handle apparatus of this kind generally includes a base member fixed to an inner surface of a door panel, a grip member which is disposed on an outer surface side of the door panel and whose one end is rotatably supported by a support pin of the base member, an escutcheon which is disposed close to the other end of the grip member and which is disposed on an outer surface side of the door panel, and a key cylinder unit whose outer periphery is covered with the escutcheon and which is fixed to the base member.

The grip member is provided at its other end with a retention arm. The retention arm is inserted into an inner surface of the door panel through a hole of the door panel. A lock unit of a door lock mechanism is detachably attached to the retention arm inserted into the inner surface of the door panel. The door lock mechanism locks a door in a vehicle body in a lock position of the lock unit, and release the locked state of the door from the vehicle body in a lock-release position of the look unit. The door lock mechanism is moved between the lock position and the lock-release position by a radio communication key unit and the key cylinder unit.

In the above configuration, when the lock unit is located in the lock position, even if an operator grips the grip member and rotates the grip member outward, since the lock unit is engaged with the lock position, the grip member is not rotated and the door cannot be opened.

On the other hand, when the lock unit is in the lock position, if the key is verified and authenticated by radio communication or the key cylinder unit is operated with a mechanical key, the lock unit is moved to the lock-release position. If the operator grips the grip member and rotates the same outward, Its rotation force rotates the grip member outward and the door can be opened.

In the conventional door handle apparatus, opposed surfaces of the grip member and the escutcheon are flat surfaces and they are disposed at a predetermined gap from each other in some cases. That is, since the other end of the grip member is moved by rotational operation, the grip member and the escutcheon are disposed close to each other through the predetermined gap from each other while taking assembling error and the like into consideration so that the grip member does not interfere with the escutcheon when the grip member is rotated. Thus, there is an adverse possibility that water enter a vehicle body from the gap between the grip member and the escutcheon at the time of car wash, and the water abruptly enters inside from a hole of the door panel. If water enters the inside of the door panel, inside parts of the door panel may be subject to corrosion.

It is therefore an object of the present invention to provide a door handle apparatus which prevents water from entering a door panel from a gap between a grip member and an escutcheon.

SUMMARY OF THE INVENTION

A door handle apparatus comprising a grip member whose one end is rotatably supported by a door panel, and an escutcheon which is disposed closer to the other end surface of the grip member and which is fixed to the door panel, wherein the door handle apparatus further comprises a water force reducing structure which reduces force of water which enters from a gap between the grip member and the escutcheon.

DETAILED DESCRIPTION OF THE INVENTION

One embodiment of the present invention will be explained below with reference to the accompanying drawings.

Figure 1:
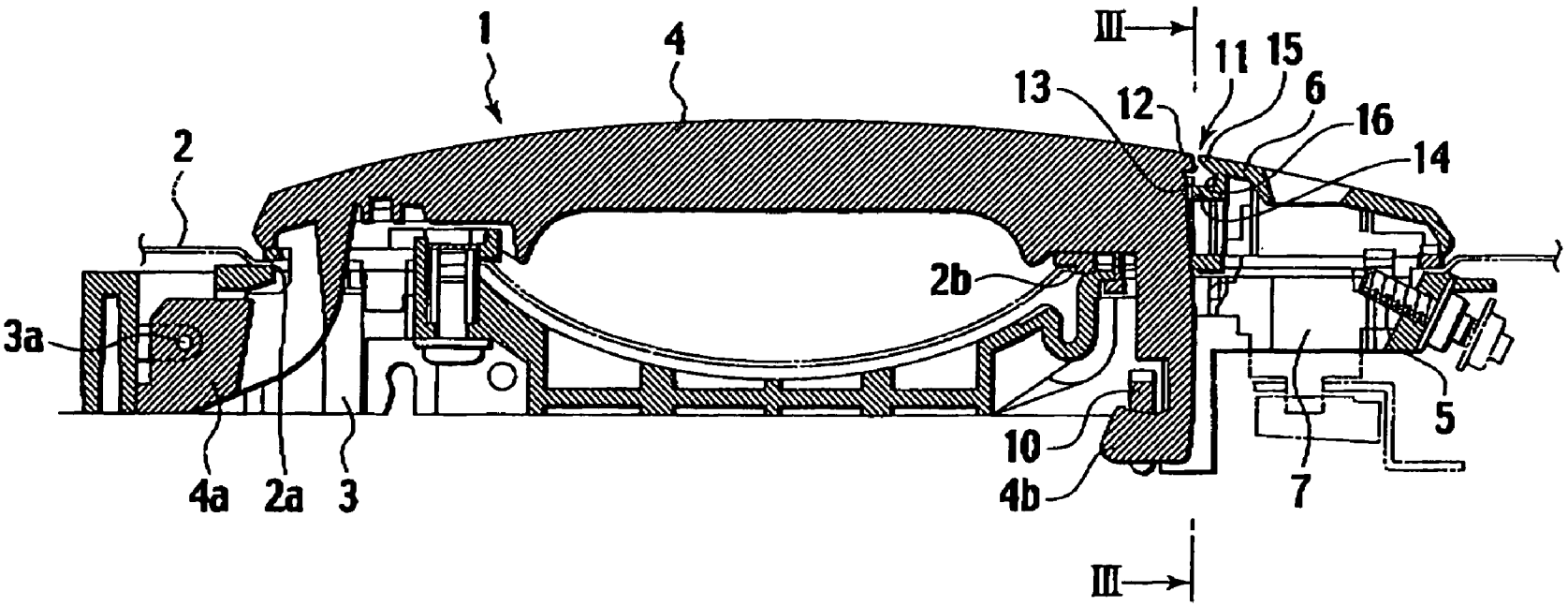
FIG. 1 shows an embodiment of the invention and is a sectional view of a grip handle type door handle apparatus.
Figure 2:
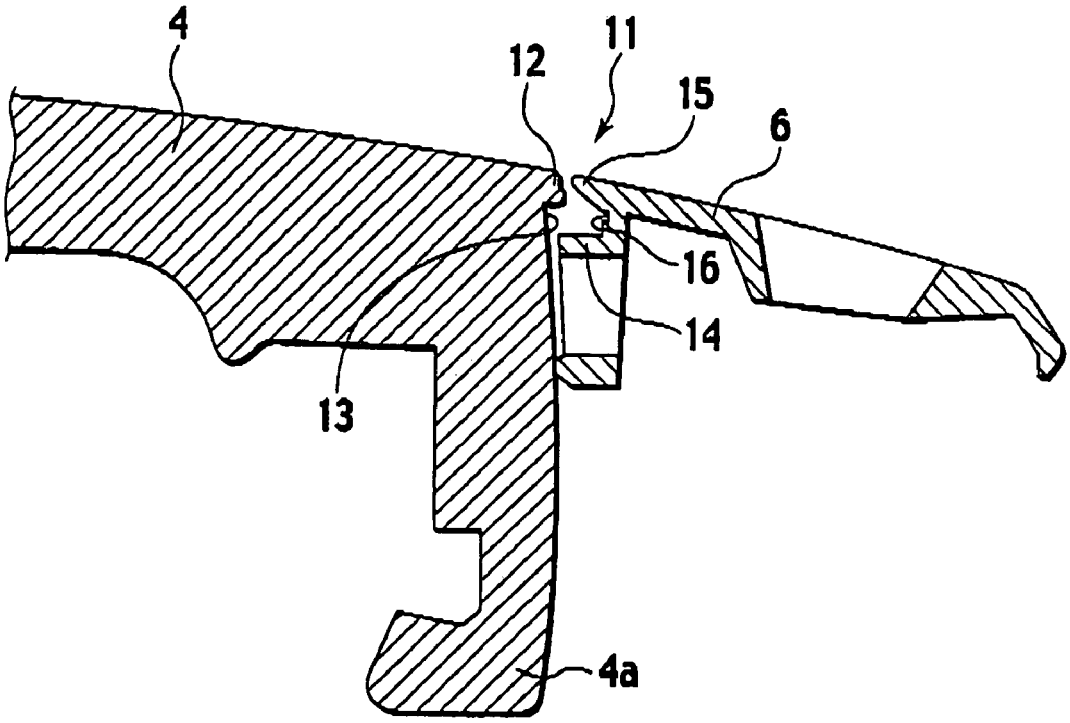
FIG. 2 shows the embodiment of the invention and is a sectional view of a relevant part showing a water force reducing structure of the door handle apparatus.
Figure 3:
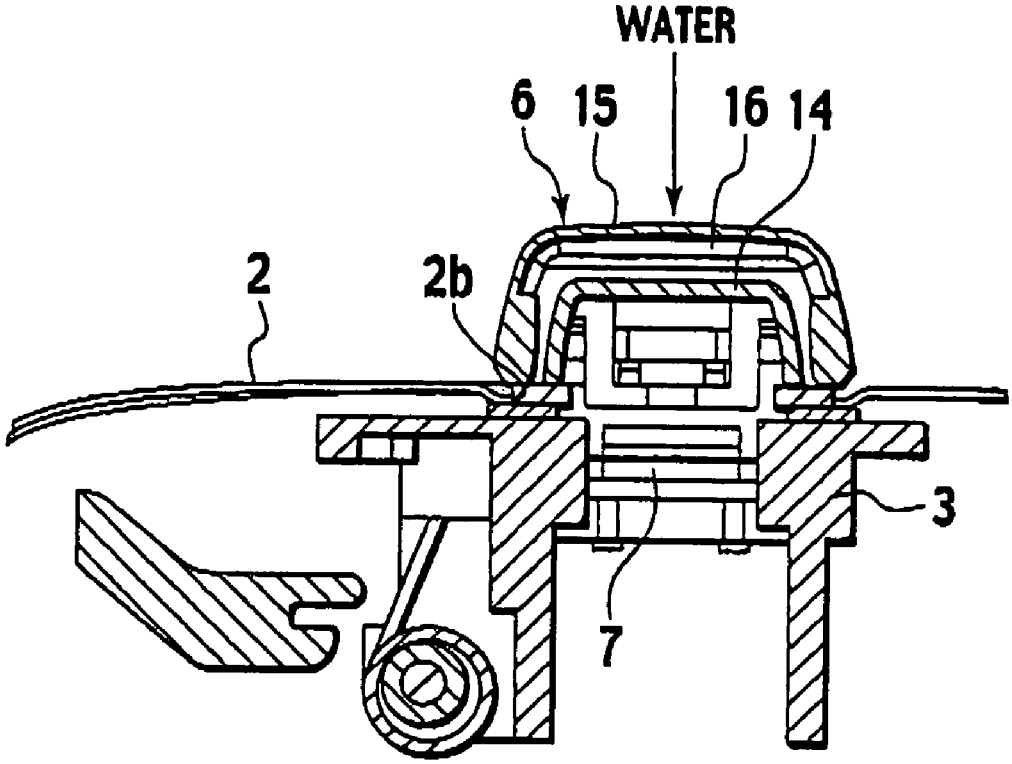
FIG. 3 shows the embodiment of the invention and is a sectional view taken along the line III-III in FIG. 1.
Figure 4:
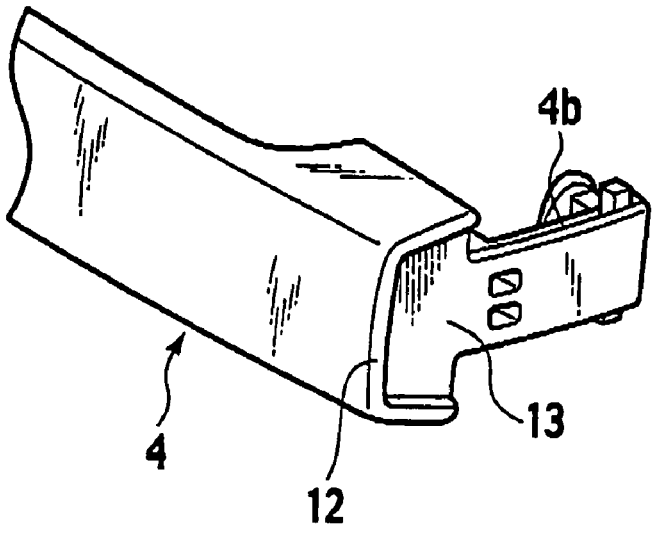
FIG. 4 shows the embodiment of the invention and is a perspective view of the other end of a grip member.
Figure 5:
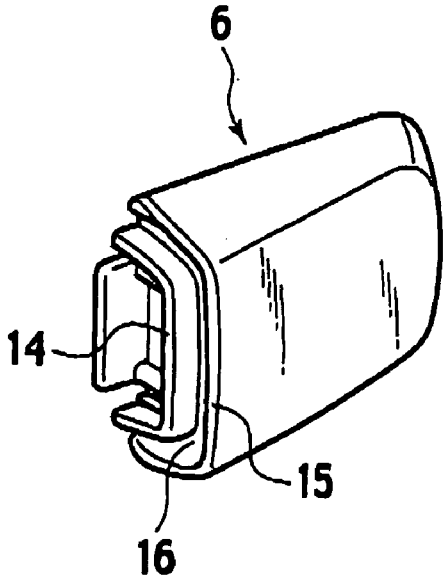
FIG. 5 shows the embodiment of the invention and is a perspective view of an escutcheon.
Figure 6:
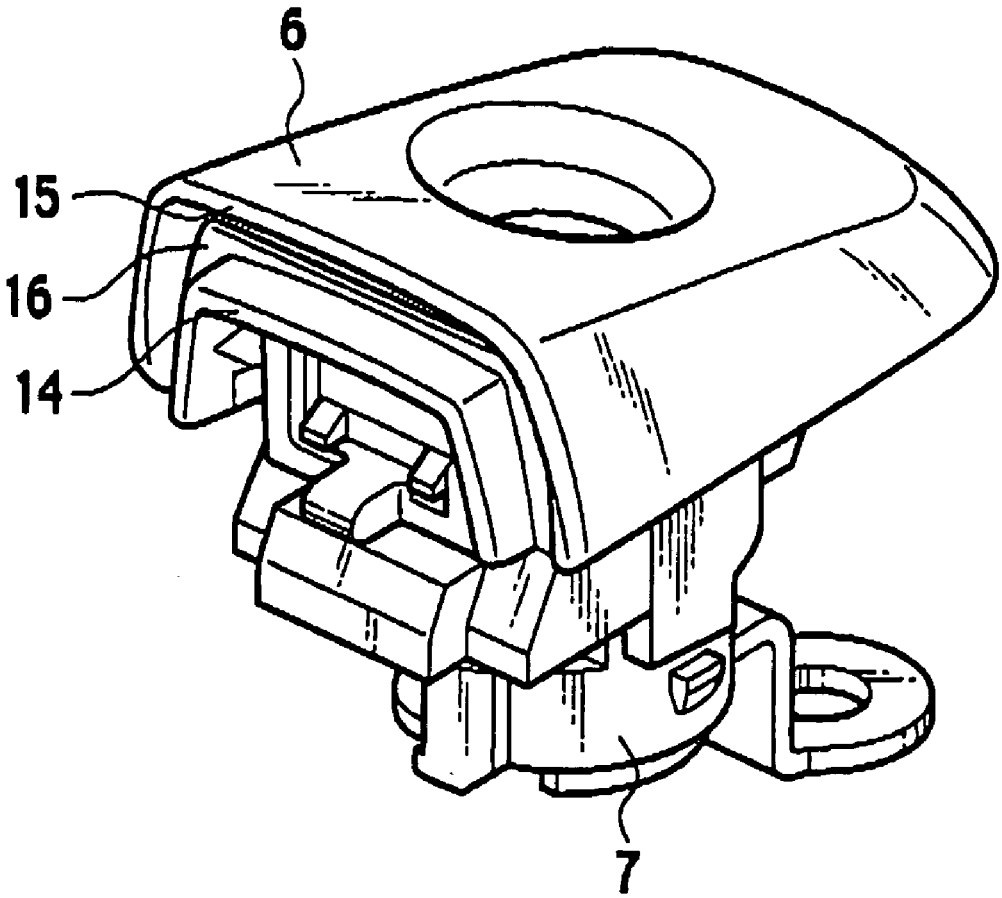
FIG. 6 shows the embodiment of the invention and is a perspective view of an assembling state between the escutcheon and a key cylinder unit.

FIGS. 1 to 6 show an embodiment of the present invention. FIG. 1 is a sectional view of a grip handle type door handle apparatus 1, FIG. 2 is a sectional view of a relevant part showing a water force reducing structure 11 of the door handle apparatus 1, FIG. 3 is a sectional view taken along the line III-III in FIG. 1, FIG. 4 is a perspective view of the other end of a grip member 4, FIG. 5 is a perspective view of an escutcheon 6, and FIG. 6 is a perspective view of an assembling state between the escutcheon 6 and a key cylinder unit 7.

As shown in FIG. 1, the door handle apparatus 1 includes a base member 3 fixed to an inner surface of a door panel 2, the grip member 4 disposed on an outer surface of the door panel 2, the escutcheon 6 which is disposed close to the other end of the door panel 2 and which is fixed to a bass member 3 through a screw 5 or the like, and the key cylinder unit 7 which is disposed on an inner surface of the door panel 2 and which is fixed to the escutcheon 6.

A base arm 4*a* projects from one end of the grip member 4. The base arm 4*a* is inserted into the inner surface of the door panel through a hole 2*a* of the door panel 2. The base arm 4*a* inserted into the inner surface of the door panel 2 is rotatably supported by a support pin 3*a* of the base member 3. That is, one end of the grip member 4 is rotatably supported by the door panel 2 through the base member 3. A retention arm 4*b* projects from the other end of the grip member 4. The retention arm 4*b* is inserted into the inner surface of the door panel through a hole 2*b* of the door panel 2. The retention arm 4*b* inserted into the inner surface of the door panel 2 is disposed such that the retention arm 4*b* can be engaged with and disengaged from the lock unit 10 of the door lock mechanism. The door lock mechanism locks a door in a vehicle body when the lock unit 10 is in a lock position, and releases the locked state of the door from the vehicle body when the lock unit 10 is in a lock-release position. The door lock mechanism is moved between the lock position and the lock-release position by a radio communication key unit and the later-described key cylinder unit 7.

The key cylinder unit 7 can lock and release the lock by operation of a mechanical key (not shown). A door lock mechanism (not shown) is connected to the key cylinder unit 7, and if the key cylinder unit 7 is locked, the lock unit 10 of the door lock mechanism is moved to the lock position, and if the key cylinder unit 7 is released, the lock unit 10 of the door lock mechanism is moved to the lock-release position. The key cylinder unit 7 has a key insertion hole (not shown). The location of the key insertion hole projects toward an outer surface of the door panel through the hole 2*b* of the door panel 2. The escutcheon 6 is disposed such as to cover an outer periphery of the key cylinder unit 7 which projects toward the outer surface of the door panel 2.

The water force reducing structure 11 is provided at a location where the grip member 4 and the escutcheon 6 are opposed to each other. As shown in FIGS. 2 to 6 in detail, the water force reducing structure 11 is provided on the grip member 4, and the water force reducing structure 11 a canopy 12 which is provided on the grip member 4 and projects toward the escutcheon 6, a rib 14 provided on the side of the escutcheon 6 and projects toward a recessed surface 13 inside of the canopy 12, and a groove 16 provided between the rib 14 and an outer peripheral end 15 of the escutcheon 6. As shown in FIG. 4 in detail, the canopy 12 is provided in three directions along an outer periphery of the grip member 4, i.e., the canopy 12 is provided to cover three outward directions as viewed from inside of the door panel 2. As shown in FIGS. 5 and 6 in detail, the rib 14 and the groove 16 are provided in three outward directions as viewed from inside of the door panel 2, i.e., the rib 14 and the groove 16 are provided to cover three outward directions as viewed from inside of the door panel 2.

In the above configuration, when the lock unit 10 of the door lock mechanism (not shown) is located in the lock position, even if an operator grips the grip member 4 and rotates the grip member 4 outward, since the lock unit 10 is engaged with the grip member 4, the grip member 4 is not rotated and the door cannot be opened.

When the lock unit 10 of the door lock mechanism (not shown) is located in the lock position, if the key is verified and authenticated by radio communication or the key cylinder unit 7 is operated with a mechanical key (not shown), the lock unit is moved to the lock-release position. If the operator grips the grip member 4 and rotates the same outward, its rotation force rotates the grip member 4 outward and the door can be opened.

If water is injected between a gap between the grip member 4 and the escutcheon 6 at the time of car wash or the like, water enters the vehicle body from the gap between the grip member 4 and the escutcheon 6. The water force of the water is reduced by the water force reducing structure 11. More specifically, the gap between the grip member 4 and the escutcheon 6 functions as a passage which is bent by the canopy 12 and the rib 14, there exists the groove 16 between the rib 14 and the outer peripheral end 15 of the escutcheon 6, and a portion of water stays in the groove 16. Therefore, water is prevented from reaching inside from the hole 2*b* of the canopy 12 to a great extent.

That is, in this embodiment, the grip member 4 is provided with the water force reducing structure 11, and the water force reducing structure 11 includes the canopy 12 projecting toward the escutcheon 6 and the rib 14 projecting toward the recessed surface 13 inside of the canopy 12. Therefore, the gap between the grip member 4 and the escutcheon 6 functions as the passage bent by the canopy 12 and the rib 14 and thus, water is prevented from reaching inside from the door panel 2 to a great extent. It is difficult to insert a tool such as a driver into the door panel 2 from the gap between the grip member 4 and the escutcheon 6, and this is effective for keeping out of mischief and burglary.

In this embodiment, since the water force reducing structure 11 includes the groove 16 between the rib 14 and the outer peripheral end 15 of the escutcheon 6, a portion of water entering between the grip member 4 and the escutcheon 6 enters the groove 16 and stays therein. Therefore, it is possible to more reliably prevent the water from reaching inside of the door panel 2.

In this embodiment, since the rib 14 is provided to cover three outward directions as viewed from inside of the door panel 2, it is possible to prevent water from reaching the inside of the door panel 2 through the rib 14. Thus, it is possible to more reliably prevent water from entering the door panel 2.

In this embodiment, since the groove 16 is provided to cover three outward directions as viewed from inside of the door panel 2, the amount of entering water which stays in the groove 16 can be increased. Thus, it is possible to more reliably prevent water from entering the door panel 2.

Furthermore, in this embodiment, since the canopy 12 is provided to cover three outward directions as viewed from inside of the door panel 2, the amount of water entering the gap between the grip member 4 and the escutcheon 6 can be reduced and thus, water can be prevented from entering the door panel 2 more reliably also from this reason.

While the present invention has been described in detail by the embodiments, it should be clear to persons skilled in the art that the invention is not limited by the embodiments in this application. The apparatus according to the present invention will be variously changed or modified without departing from the spirit and the scope of the invention as defined by the appended claims. Therefore, the description in this application is intended only for illustrative purposes and not restrictive in all respects.

What is claimed is:

1. The door handle apparatus comprising:

a grip member whose one end is rotatably supported by a door panel;

an escutcheon which is disposed closer to an end surface of the grip member and which is fixed to the door panel; and a water force reducing structure which reduces force of water which enters from a gap between the grip member and the escutcheon, the water force reducing structure including a canopy formed from at least one of the grip member and the escutcheon, and a water retaining structure capable of retaining water and thereby reduce water reaching inside the door panel by reducing the force of water which enters from the gap between the grip member and the escutcheon, wherein the water force reducing structure includes a canopy which is provided on the grip member and which projects toward the escutcheon, and a rib which is provided on the escutcheon and which projects toward a recessed surface inside of the canopy, wherein the water force reducing structure includes a groove provided between the rib and an outer peripheral edge of the escutcheon, whereby water entering the vehicle body becomes entrained in the groove, thereby reducing an amount of water entering the inside of the door panel.

2. The door handle apparatus according to claim 1, further comprising:

a lock unit;

a retention arm operatively connected to the grip member, the retention arm inserted into an inner surface of the door panel and disposed to permit engagement with a lock unit, the lock unit operable by at least one of radio communication or a mechanical key cylinder unit.

3. The door handle apparatus according to claim 1, further comprising:

a lock unit;

a mechanical key cylinder unit projects toward an outer surface of the door panel;

a retention arm operatively connected to the grip member, the retention arm inserted into an inner surface of the door panel and disposed to permit engagement with a lock unit, the lock unit operable by at least one of radio communication or the mechanical key cylinder unit;

a key insertion hole projecting toward the outer surface of the door panel through the door panel and the escutcheon disposed such as to cover an outer periphery of the key cylinder unit.

4. The door handle apparatus according to claim 1, wherein the rib is provided to cover three outward directions as viewed from inside of the door panel.

5. The door handle apparatus according to claim 1, wherein the groove is provided to cover three outward directions as viewed from inside of the door panel.

6. The door handle apparatus according to claim 1, wherein the canopy is provided to cover three outward directions as viewed from inside of the door panel.

7. A door handle apparatus comprising:

a grip member whose one end is rotatably supported by a door panel, and an escutcheon which is disposed closer to the other end surface of the grip member, opposed thereto, and which is fixed to the door panel, wherein the door handle apparatus further comprises a water force reducing structure which reduces force of water which enters from a gap between the grip member and the escutcheon, wherein the water force reducing structure includes a canopy which is provided on the grip member and which projects toward the escutcheon, and a rib which is provided on the escutcheon and which projects toward a recessed surface inside of the canopy, wherein the water force reducing structure includes a groove provided between the rib and an outer peripheral edge of the escutcheon, and wherein the gap functions as a bent passageway.

8. The door handle apparatus according to claim 7, wherein the groove is provided to cover three outward directions as viewed from inside of the door panel.

9. The door handle apparatus according to claim 7, wherein the rib is provided to cover three outward directions as viewed from inside of the door panel.

10. The door handle apparatus according to claim 7, wherein the canopy is provided to cover three outward directions as viewed from inside of the door panel.

11. A door handle apparatus, comprising:

a base member fixed to an inner surface of a door panel;

a grip member disposed on an outer surface of the door panel;

an escutcheon which is disposed close to one end of the door panel and which is fixed to the base member;

a key cylinder unit which is disposed on an inner surface of the door panel and which is fixed to the escutcheon; and a water force reducing structure provided at a location where the grip member and the escutcheon are opposed to each other, wherein the water force reducing structure reduces force of water which enters from a gap between the grip member and the escutcheon, wherein the water force reducing structure includes a canopy which is provided on the grip member and which projects toward the escutcheon, and a rib which is provided on the escutcheon and which projects toward a recessed surface inside of the canopy, wherein the water force reducing structure includes a groove provided between the rib and an outer peripheral edge of the escutcheon, and wherein the gap functions as a bent passageway.

12. The door handle apparatus according to claim 11, wherein the rib is provided to cover three outward directions as viewed from inside of the door panel.

13. The door handle apparatus according to claim 12, wherein the groove is provided to cover three outward directions as viewed from inside of the door panel.

* * * * *

UNITED STATES PATENT AND TRADEMARK OFFICE

CERTIFICATE OF CORRECTION

PATENT NO. : 7,437,803 B2
APPLICATION NO. : 11/138387
DATED : October 21, 2008
INVENTOR(S) : Watanabe et al.

It is certified that error appears in the above-identified patent and that said Letters Patent is hereby corrected as shown below:

Claim 1, Column 4, Line 48,

Please delete "The door handle"

and replace with

-- A door handle --

Signed and Sealed this

Thirtieth Day of December, 2008

JON W. DUDAS
*Director of the United States Patent and Trademark Office*